US007862366B2

(12) United States Patent
Stone et al.

(10) Patent No.: US 7,862,366 B2
(45) Date of Patent: Jan. 4, 2011

(54) ELECTRICAL CONNECTOR WITH LOCKING CLIP

(75) Inventors: Randall G. Stone, McHenry, IL (US); Joseph F. Murphy, Highland Park, IL (US); Jimmy E. Adjunta, Lincolnshire, IL (US)

(73) Assignee: Woodhead Industries, Inc., Lincolnshire, IL (US)

( * ) Notice: Subject to any disclaimer, the term of this patent is extended or adjusted under 35 U.S.C. 154(b) by 0 days.

(21) Appl. No.: 12/577,982

(22) Filed: Oct. 13, 2009

(65) Prior Publication Data

US 2010/0093205 A1 Apr. 15, 2010

(51) Int. Cl.
*H01R 13/627* (2006.01)

(52) U.S. Cl. ..... 439/352; 439/304; 285/305

(58) Field of Classification Search ..... 439/352, 439/304, 350, 351, 357; 285/305, 321
See application file for complete search history.

(56) References Cited

U.S. PATENT DOCUMENTS

| | | | | | |
|---|---|---|---|---|---|
| 2,084,431 | A * | 6/1937 | Catley | 285/314 |
| 2,194,769 | A * | 3/1940 | Reed | 439/358 |
| 3,538,940 | A * | 11/1970 | Graham | 137/271 |
| 3,753,582 | A * | 8/1973 | Graham | 285/305 |
| 4,526,411 | A * | 7/1985 | Bartholomew | 285/305 |
| 5,000,614 | A * | 3/1991 | Walker et al. | 403/326 |
| 5,011,426 | A * | 4/1991 | Colleran et al. | 439/357 |
| 5,055,057 | A * | 10/1991 | Boyer | 439/134 |
| 5,330,361 | A * | 7/1994 | Brend | 439/134 |
| 5,723,818 | A * | 3/1998 | Yeh | 174/74 R |
| 5,988,705 | A * | 11/1999 | Norkey | 285/319 |
| 6,078,241 | A * | 6/2000 | Watanabe et al. | 336/92 |
| 6,681,458 | B2 * | 1/2004 | Seymour | 24/675 |
| 6,983,958 | B2 * | 1/2006 | Rautureau | 285/305 |
| 6,997,486 | B2 * | 2/2006 | Milhas | 285/305 |
| 7,090,523 | B2 * | 8/2006 | Shirk et al. | 439/352 |
| 7,201,403 | B2 * | 4/2007 | Takayanagi et al. | 285/321 |
| 7,338,092 | B1 * | 3/2008 | Cicconi, III | 285/305 |
| 7,387,318 | B2 * | 6/2008 | Yoshida | 285/321 |
| 7,393,019 | B2 * | 7/2008 | Taga et al. | 285/321 |
| 7,597,362 | B2 * | 10/2009 | Hartmann | 285/321 |
| 2005/0153593 | A1 * | 7/2005 | Takayanagi et al. | 439/352 |
| 2005/0164541 | A1 * | 7/2005 | Joy et al. | 439/352 |

* cited by examiner

*Primary Examiner*—Neil Abrams
*Assistant Examiner*—Harshad C Patel
(74) *Attorney, Agent, or Firm*—Larry I. Golden

(57) ABSTRACT

An electrical connector assembly includes first male and second female connectors having respectively a generally annular locking spring with inwardly directed flexible tines and an outer cylindrical coupling member. The tines are deflected outwardly by the outer coupling member when the second connector is inserted into the first connector for coupling the connectors. A locking clip having a pair of identical, semi-cylindrical mating sections adapted for mutual engagement and manual assembly about the coupled first and second connectors locks the two connectors together to prevent inadvertent disconnection. An uncoupling tool adapted for insertion in respective opposed slots in the two connected mating sections of the lock clip engages and axially displaces a release sleeve in one of the connectors, which, in turn, engages and outwardly deflects the locking clip's tines permitting the non-destructive separation of the two connectors.

19 Claims, 7 Drawing Sheets

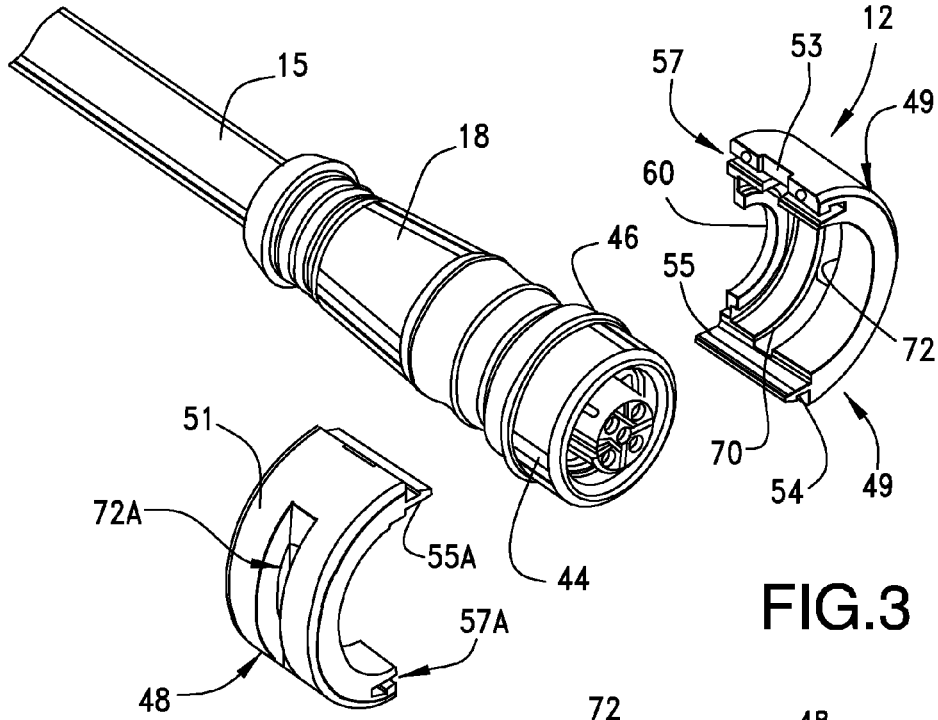
FIG.3
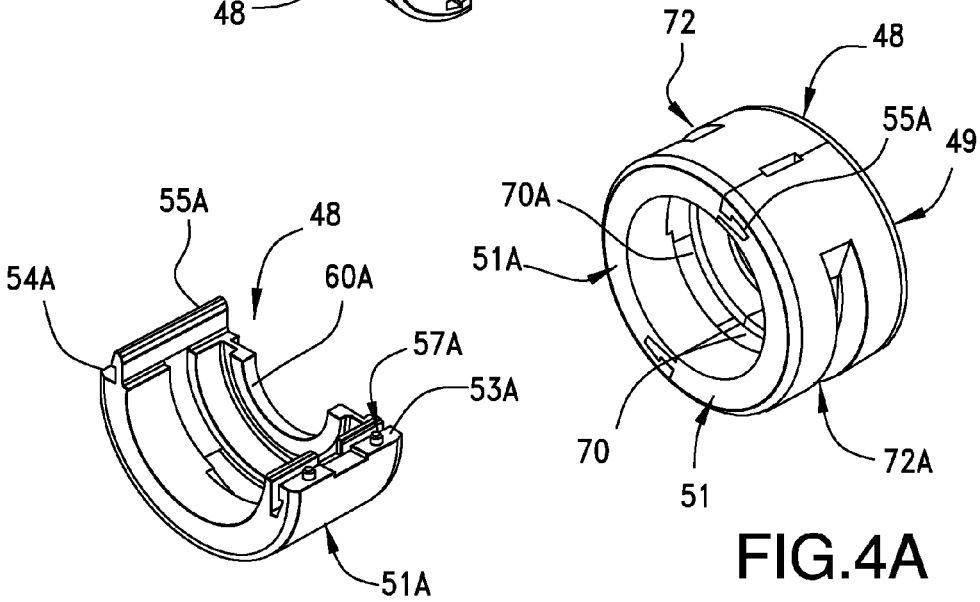
FIG.4A
FIG.4B

ELECTRICAL CONNECTOR WITH LOCKING CLIP

FIELD OF THE INVENTION

The invention relates to an electrical connector assembly comprising male and female mating connectors. A first connector (male or female) includes a generally annular locking spring having centrally projecting flexible tines which are inclined slightly in the direction of insertion of the mating connector. The tines define an opening for receiving and coupling to the outer surface of a cylindrical coupling member of a second, mating connector. As the mating connector is assembled to the first connector, the cylindrical coupling member of the mating connector engages and deflects the tines of the locking spring in the direction of insertion, thereby enlarging the receiving opening formed by the tines and admitting the mating connector while locking onto its outer surface, thereafter preventing separation.

The first connector has an axially slidable actuator sleeve having a circumferential rib and an annular engagement portion sized and arranged to slide along the cylindrical member of the second connector when the connectors are engaged. This motion displaces and pivots the tines of the annular locking spring, to increase the size of the receiving opening defined by the inner edges of the tines of the locking spring, thereby releasing the mating connector for removal.

A locking clip in the general form of a band comprised of identical mating sections each in the general form of a semi-cylinder may be assembled by hand over the first connector (in which the locking spring is mounted). The locking clip cannot be removed without destroying it. The locking clip, when assembled to the exterior of the first connector, covers the release sleeve and prevents manual manipulation of it, thereby preventing inadvertent manual disconnection of the two mating connectors by requiring application of an uncoupling tool to effect release.

The uncoupling tool has spaced-apart legs tapered to their respective insertion or distal ends which may be inserted respectively into narrow, aligned, opposing slots, one in each half of the locking clip. When urged along a plane perpendicular to the axis of connection, the legs of the uncoupling tool engage the circumferential rib on the release sleeve and force the release sleeve in an axial direction to deflect the tines of the locking clip and move them to form a larger circumference, releasing the coupling member of the mating connector into a release position, thereby freeing the connectors for separation.

BRIEF DESCRIPTION OF THE DRAWINGS

FIG. 3 is a perspective view of the first connector in FIG. 1 with the two halves of the locking clip in exploded relation;

FIG. 4A is a perspective view showing the locking clip in its assembled relation;

FIG. 4B is a perspective view of one half of the locking clip;

DESCRIPTION OF THE ILLUSTRATED EMBODIMENTS

Figure 1:
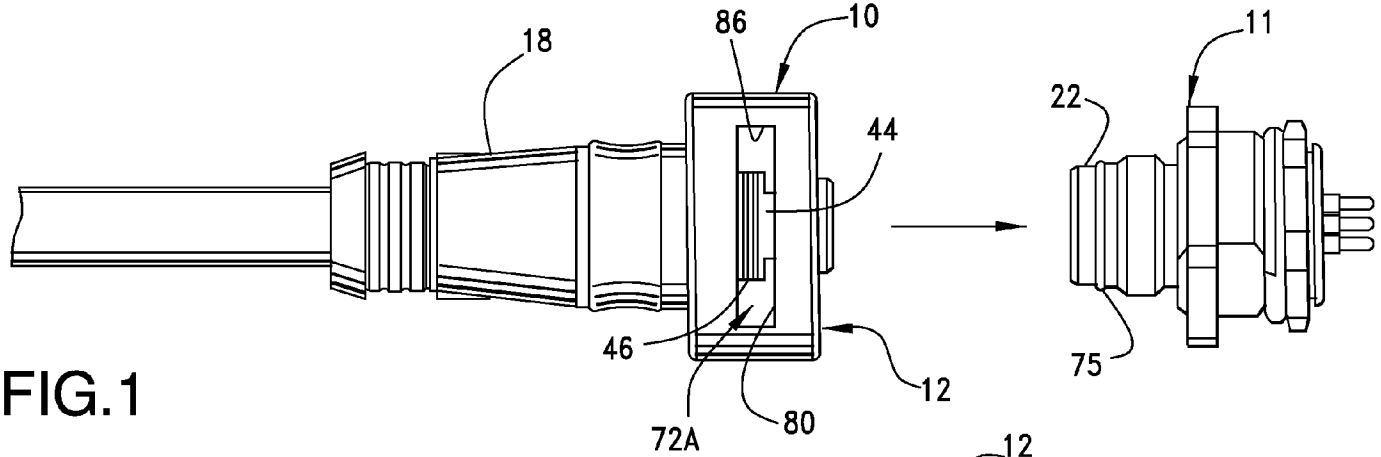
FIG. 1 is a side elevational view of a male and a female mating connector including a first connector on the left and a mating connector on the right; the locking clip is installed on the first connector.

The present invention relates to a connector assembly—that is, it relates to a male and female mating electrical connectors. The improvement disclosed herein relates to the incorporation of a locking clip which may be applied to one of the two mating connectors in order to prevent them from being disconnected once they have been connected except by the use of an uncoupling tool.

The locking structure and associated locking clip may be incorporated into either the male or female connector. In the illustrated embodiment, the locking clip and associated locking spring are incorporated into the female connector. However, they could equally well be applied to or incorporated in the male connector. Therefore, reference is made herein to a "first" connector (which contains the locking spring and the locking clip, as will be understood from the following description) which may be either female or male, and a "mating" connector which is the other.

In particular, the present invention relates to a type of quick-disconnect connector including mating male and female connectors of a "plug" type. That is, the connectors are connected together by forcing the connecting elements (typically pins) of the male connector into associated connector elements (sockets) in the female connector.

The type of connector assembly with which the present invention is concerned typically is used in an industrial environment, such as in the manufacturing automation industries. In this type of environment, the conditions of use are typically harsh and quick disconnectors are used throughout a typical facility. It is not unusual for these quick disconnect connectors to be disassembled. This may have the effect of shutting down a machine or an assembly line, or interrupting a computer-based controller system.

Therefore, a connector was developed, which is disclosed in PCT Application WO2004DE00793 20040414, published Dec. 16, 2004, which is incorporated herein in its entirety. In this connector, a retaining spring in the form of an annular ring having flexible tines extending inwardly is incorporated into one of the connectors. The tines are located so as to receive a cylindrical coupling member of the associated mating connector. When the cylindrical coupling member of the associated mating connector is forced into the first connector (having the annular locking element), the tines of the locking element are moved rearwardly (that is, in the direction of insertion of the mating connector). This action displaces the tines rearwardly and forces them such that the innermost free edges of the individual tines define an opening of larger circumference than when they were at rest (i.e. before the mating connector is inserted). Typically, the coupling member of the mating connector has an annular recess positioned such that when the mating connector is fully connected to the first connector the innermost edges of the tines of the retaining ring move into the annular ring thereby locking the mating connector into assembled relation with the first connector. As used herein, the "axial" direction or direction of connection (or disconnect) is along the chain line C/L in FIG. 6.

A sliding actuator sleeve is provided in the first connector which may be manually actuated by moving it rearwardly (that is, away from the mating connector). The sliding actuator sleeve is provided with an actuating portion which forces all of the tines of the retention ring into an expanded diameter so that the inner most edges of the tines are moved out of the annular recess on the coupling member of the mating connector, and the mating connector is free to be removed simply by pulling it in an opposing axial direction.

This type of connector has become popular and lends itself to applications involving hazardous locations, such as oil refineries and chemical plants which require special precautions against inadvertent disconnection which might generate a spark.

Referring first to FIG. 1, reference numeral 10 generally designates a first electrical connector, and reference numeral 11 generally designates a mating electrical connector. In the illustrated embodiment, the first connector 10 is a female connector and the mating connector 11 is a male connector.

In the illustrated embodiment, a locking clip 12, to be discussed in further detail within, is assembled to the first connector 10. However, as persons skilled in the art will readily appreciate, a similar locking clip 12 could equally well be placed on a male connector if the release mechanism to be described were instead incorporated into the mating connector 11.

Figure 2:
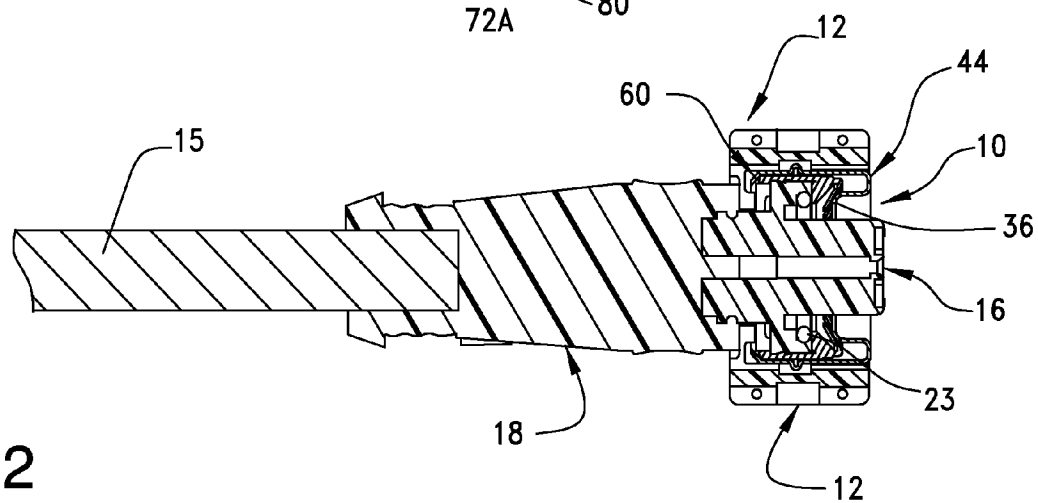
FIG. 2 is a horizontal cross sectional view of the first connector in FIG. 1 taken along a plane passing through the center line of the connector and its associated cable.

Turning now to FIG. 2 as well as FIG. 1, and referring particularly to the elements of the first connector 10, the connector 10 is coupled to the wires of a cable 15 which typically might include 2-12 insulated wires, the stripped ends of which are connected to the connector elements (which would be sockets in the illustrated embodiment since the connector 10 is a female connector). The connector elements, whether male or female, are typically embedded and supported by an insulating member called an insert, designated 16 in FIG. 2. The rear (left) end of the insert 10 and the associated connecting wires are covered by an overmold structure 18 which may be a synthetic material such as rubber to provide strain relief for the connection between the cable wires and their associated connector elements mounted in the insert 16. The remaining portion of the connecting wires (not shown in FIG. 2) are enclosed within the cable 15, as is commonly known.

The male connector or receptacle 11 is conventional, having its own insert for securing the corresponding connector elements which are typically pins in a male connector of this type. Although not seen in FIG. 1, the connecting elements of the male connector terminate in sockets such as that designated 26 in FIG. 6 which in turn are connected to wires in another cable or directly to a printed circuit board as a fixed component in a system, in the case where the male connector is, for example, mounted to a panel. In the illustrated embodiment, the male or mating connector 11 is a panel-mounted version.

Turning now to FIG. 3, it can be seen that the first connector 10 is integrally connected to the overmold 18 and cable 15. As seen in FIG. 1, the mating connector 11 includes a cylindrical coupling member 22 which surrounds and protects the male connecting elements. An annular groove 75 is formed on the outer wall of the cylindrical coupling member 22.

Figure 6:
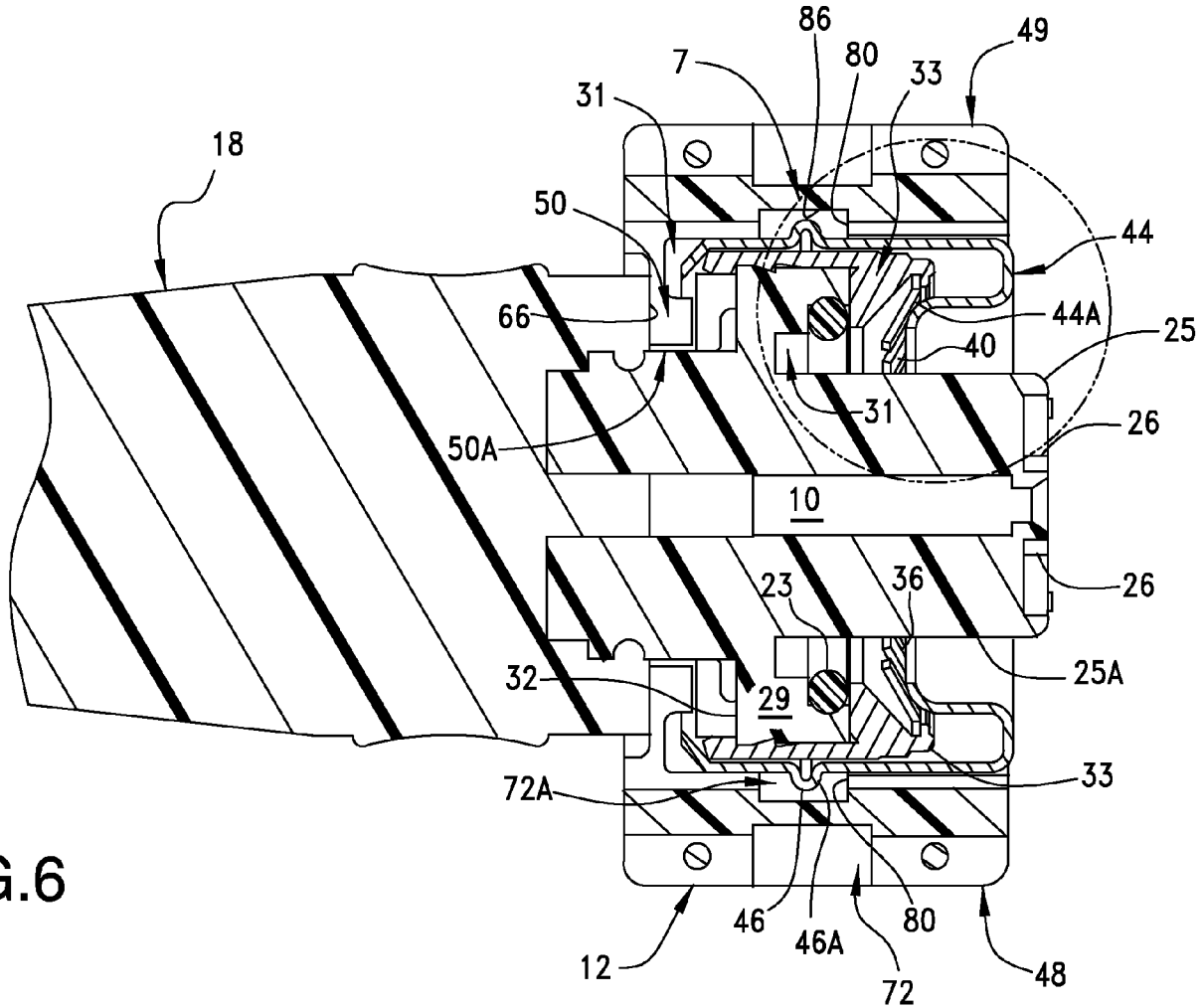
FIG. 6 is a close up horizontal cross sectional view of the first connector shown in FIG. 1 along a plane extending through the axis of connection.

Turning now to FIG. 6, there is shown an enlarged cross section of the first connector 10. It includes an insert 25 in which are embedded the female connecting elements 26, in the form of sockets. The sockets 26, of course, are electrically connected to the wires of the cable 15. Still referring to FIG. 6, the insert 25 includes a receiving sleeve 29 which is spaced outwardly from the cylindrical side surface 25A of the insert forming an annular space generally designated 31 into which the cylindrical coupling member 22 of the mating connector 11 is placed during connection. An O ring 23 engages the outer surface of the cylindrical coupling member 22 when the two connectors are assembled to form a seal.

Mounted on the receiving sleeve 29 is a spring retainer 33. The spring retainer 33 is annular in shape and fixed to the receiving sleeve 29 by two barbs 34 formed on the inner surface of the spring retainer. The spring retainer 33 cooperates with an annular cut-out portion of the receiving sleeve 29 to form an annular recess 39 for receiving the O ring 23.

Figure 7:
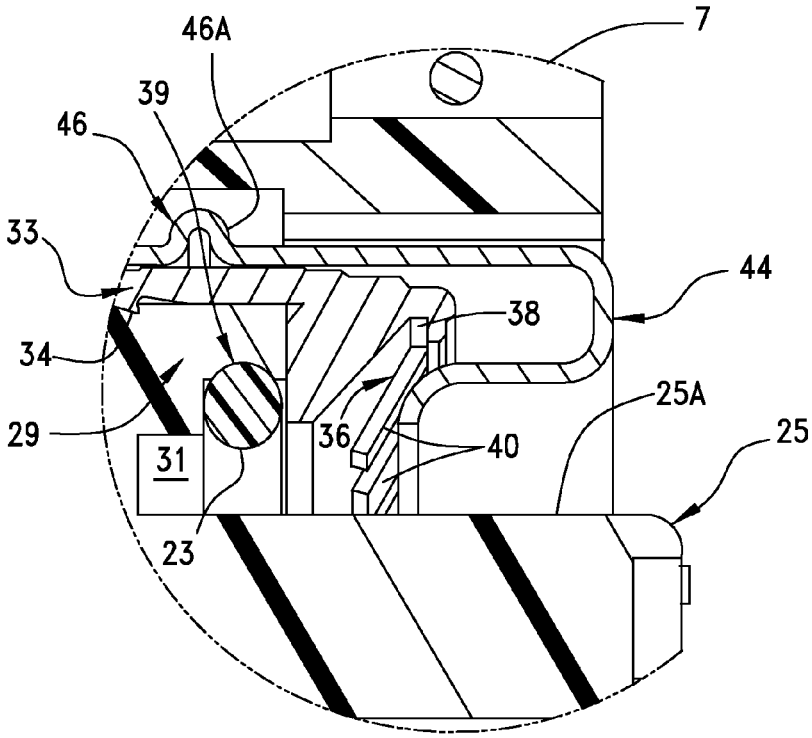
FIG. 7 is a close up view of the portion within the chain line circle 7 of FIG. 6.

Referring to FIGS. 6 and 7, mounted to the forward portion (i.e. in the direction of connection, to the right in FIGS. 6 and 7) of the spring retainer 33 is a retaining or locking spring 36. The spring 36 includes an outer circumferential ring 38 in the form of a circular, generally flat washer which is integrally formed with a plurality of tines, designated 40, which extend inwardly toward the center of the ring 38 and are inclined slightly toward the rear—i.e. the direction of insertion of the mating connector. The tines 40 are spaced about the entire ring 38 with equal angular space between adjacent tines.

The inner or center most edges of all of the tines 40 define a circular opening for receiving the outer surface of the cylindrical coupling member 22 of the mating connector. When the coupling member 22 is placed on the insert 25 of the first connector and slid axially into connecting relation (that is to the left in FIG. 6), each of the tines 40 is forced inwardly (to the left in FIG. 6). Because the ring 38 is fixed, the opening formed by the tines which originally is only slightly less than the outer circumference of the cylindrical coupling member 22 of the mating connector) is enlarged so that during insertion, the tines slide along the outer surface of the coupling member until the mating connector is fully seated. At that time, the tines are located in the circumferential groove 75 (FIG. 1) of the cylindrical coupling member 22 of the mating connector 11, and the two are locked together since any attempt to pull the first connector 10 away from the mating connector 11 would cause the tines to jam against the cylindrical coupling member 22 and prevent its withdrawal.

Thus, the two connectors cannot be disconnected through any accidental action or through vibration or the like or anything else that might happen in typical use.

In order to release the mating connector, a sliding actuator sleeve 44 is located adjacent the spring retainer 33. The sliding actuator sleeve includes an actuator section 44A in the form of an annular surface which is curved in the lateral direction of motion as seen in FIG. 6, and which engages the tines 40 adjacent the base or mounting ring 38. It will be observed that when the sliding actuator sleeve 44 is moved to the left in FIG. 6, the curved actuator section 44A displaces the tines 40 of the spring retainer 33 toward the insertion direction (that is to the left in FIG. 6) thereby forcing the tines 40 to assume a position such that their innermost edges form an opening of increased circumference. This disengages the innermost ends of the tines 40 from the annular groove 75 of the mating connector, thereby freeing the mating connector which may then be manually removed and disconnected from cylindrical coupling member 22 the first connector 10.

However, as noted above, for safety or other reasons, it may be desirable to restrict the manual release of the two connectors to only those authorized to do so.

Turning now to the locking clip 12, it is intended to be permanently secured to a connector body with removal prevented. The illustrated locking clip 12 may be applied manually, without the need for special tools, as will be further described, simply by assembling two mating parts together about the exterior of a connector. As indicated, the locking clip is intended for use in those areas, such as an area containing hazardous material, in which it is desired to prevent inadvertent, accidental or unauthorized disconnection of an electrical connector assembly.

Turning now to FIG. 3, the locking clip 12 includes first and second half sections 48, 49. The half sections 48, 49 may be identical in structure so that only one need be described in detail for a complete understanding of the invention. Because the two half sections 48, 49 are shown identical in structure, the same element numbers are used in both half sections to identify common elements, with those elements in half section 48 having the letter designation "A" added to the element number. Turning then to the half section 48 of FIG. 4B, it includes a semi-cylindrical wall 51A, terminating in two axially extending edges 53A, 54A. Formed on the edge 54A of the wall 51A is a barbed tongue 55A which extends along the axial length of the edge 54A. A receptacle 57A is formed in the edge 53A of the side wall 51A, and has an interior shape corresponding to the exterior shape of the barbed tongue 55 on a mating half section 49.

Thus, if a correspondingly shaped half of a clip is rotated about its axis 180 degrees from the position of the clip shown in FIG. 4B, the tongue 55 which extends along the axial length of the edge 54 of locking half clip 49 would be positioned to be received in the receptacle 57A of the edge 53A of locking half clip 48, and it would have a receptacle 57 corresponding to receptacle 57A adapted to couple to the tongue 55A of the mating clip half 48, as seen in FIG. 3. When the two clip halves are thus assembled together, they form a protective cylindrical cover which, when assembled as shown in FIG. 4A surrounding a connector as disclosed above, cannot be disassembled without destroying the clip. Again, the clip halves 48, 49 may be identical in structure.

Clip half 49 (FIG. 3) includes at one axial end, a retainer flange 60 which is semi-circular in form, and has an axial thickness (see FIG. 6) which permits it to be inserted into the annular space 50 formed by the forward edge 66 of the overmold 18 and the rear radial surface 32 of the receiving sleeve 29 (FIG. 6). In this manner, when the two clip halves are coupled together, the two corresponding flanges 60, 60A, one of each clip half, form a complete, encircling retainer flange, securing the locking clip 12, in its entirety to the first connector 10.

Turning now to FIG. 3, when the two clip halves 48, 49 are assembled to the first connector 10, the coupling is effected by placing the two clip halves so that the barbed tongue 55 or 55A of one clip aligns with the receptacle 57 or 57A of the other clip, and the semi-circular retainer flanges 60, 60A of the two clip halves are placed in the annular recess 50 (FIG. 6) which is located between the forward edge 66 of the overmold 18, and the rear radial surface 32 of the receiving sleeve 29.

Turning now to FIG. 3 and FIGS. 4A and 4B, each clip half 49, 48 includes a respective inner circumferential groove 70, 70A, which extends from one end of a side wall 51, 51A to the other end. At the center of each groove 70, 70A is a respective access opening 72, 72A which extends entirely through the associated wall. The circumferential access openings 72, 72A are aligned with each other when the clip halves are assembled, and each extends circumferentially about the locking clip, and they are both aligned circumferentially with the circumferential rib 46 formed on the exterior of the sliding actuator sleeve 44 (FIGS. 3 and 6). This relationship is seen in FIG. 6 where it will be observed that the two clips 48, 49 are in assembled relation, and the circumferential opening 72 of the clip half 48 provides radial access to the adjacent portion 46A of the circumferential rib 46 of the sliding actuator sleeve 44.

It will also be observed from FIG. 6 that a forward edge designated 80 in FIG. 1 of the radial access opening 72A, lies in spaced, opposing relation to a forwardly facing surface 46A of the circumferential rib 46 of the sliding actuator sleeve 44. It is in this space that the leg of an uncoupling tool (to be described) is placed to uncouple the connectors.

Briefly, when the uncoupling tool 88 is inserted, one leg (90 or 91) is interposed between the surface 80 and the surface 46A, and further insertion of the tool downwardly as viewed in FIG. 6, wedges the two components (i.e. actuator sleeve 44 and locking clip 12) apart, forcing the peripheral rim 46 to the left in FIG. 6, thereby forcing the sliding actuator sleeve 44 to the left in FIG. 6, and rotating the individual tines 40 of the retainer spring 36 to the left or release position in FIG. 6, and increasing the circumference of the opening defined by the interior edges of the tines, and disengaging the slot of a coupling member that may be in the annular coupling space 31, thus freeing the mating connector to be released.

Figure 5:
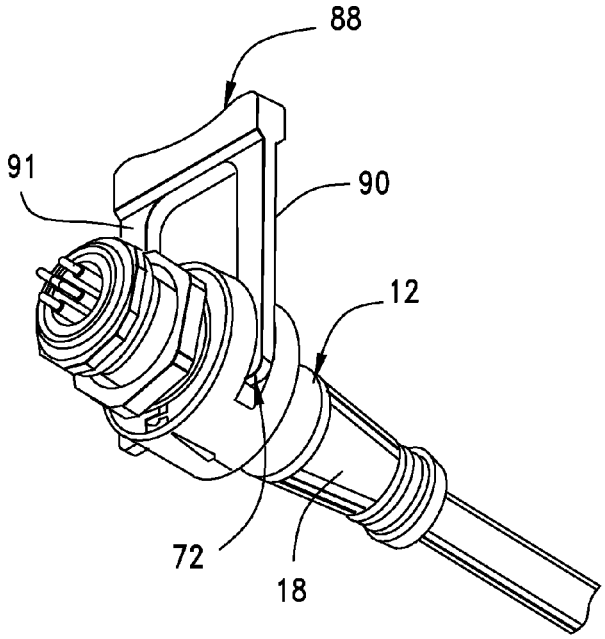
FIG. 5 is a lower perspective view showing the two connectors of FIG. 1 in assembled relation with an uncoupling tool in a position to uncouple the two connectors.
Figure 5A:
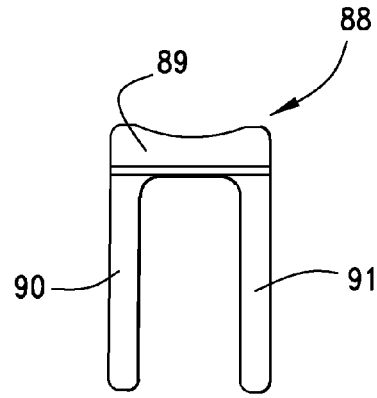
FIG. 5A is an elevational front view of the uncoupling tool of FIG. 5.
Figure 5B:
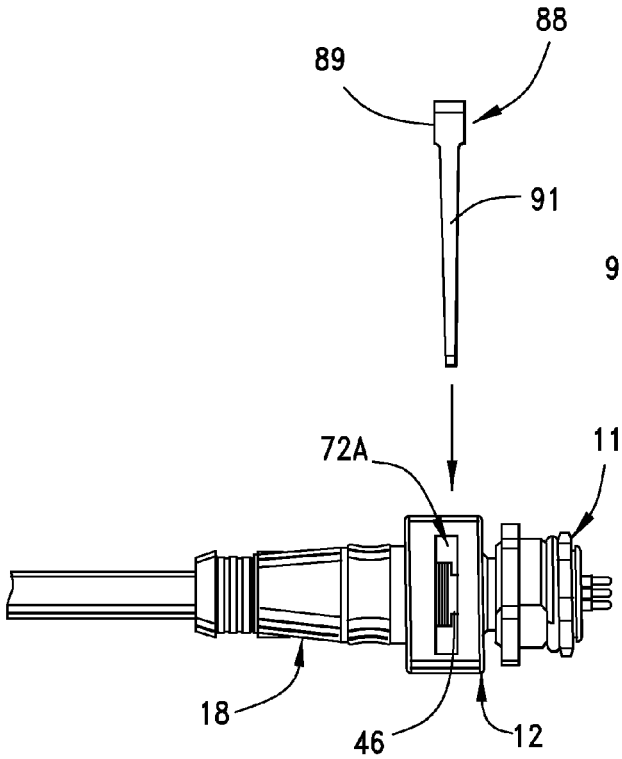
FIG. 5B is a side view of the two connectors of FIG. 5 in assembled relation and the uncoupling tool in position just prior to its being inserted into the assembled locking clip to release the two connectors.

This is illustrated in FIG. 5B, the uncoupling, or release, tool being shown in FIG. 5A and generally designated 88. It includes a cross member 89 and first and second insertion legs 90, 91.

As seen in cross section in FIG. 5B, the legs of the uncoupling tool 88 are tapered, being narrower at the distal end and wider when proceeding toward the cross member 89. In FIG. 5B (and FIG. 1), the male and female connectors are assembled, and the peripheral rim 46 of the actuating sleeve 44 can be seen through the opening 72A in the near half of the locking clip 12.

In summary, the locking clip, comprised of the two halves described, is a solitary structural member, and it is secured against axial movement relative to the connector on which it is received due to the placement of the retainer flange 60 in the annular recess 50. The legs 90, 91 of the uncoupling tool 88 (when received respectively in the two side openings 72, 72A of the clip halves) simultaneously engage the forward edge of the peripheral rim 46, and, against the reaction of the fixed clip, cams or forces the sliding actuator sleeve 44 toward the rear (that is, to the left in FIG. 6), thus freeing the mating connector for removal.

Figure 8:
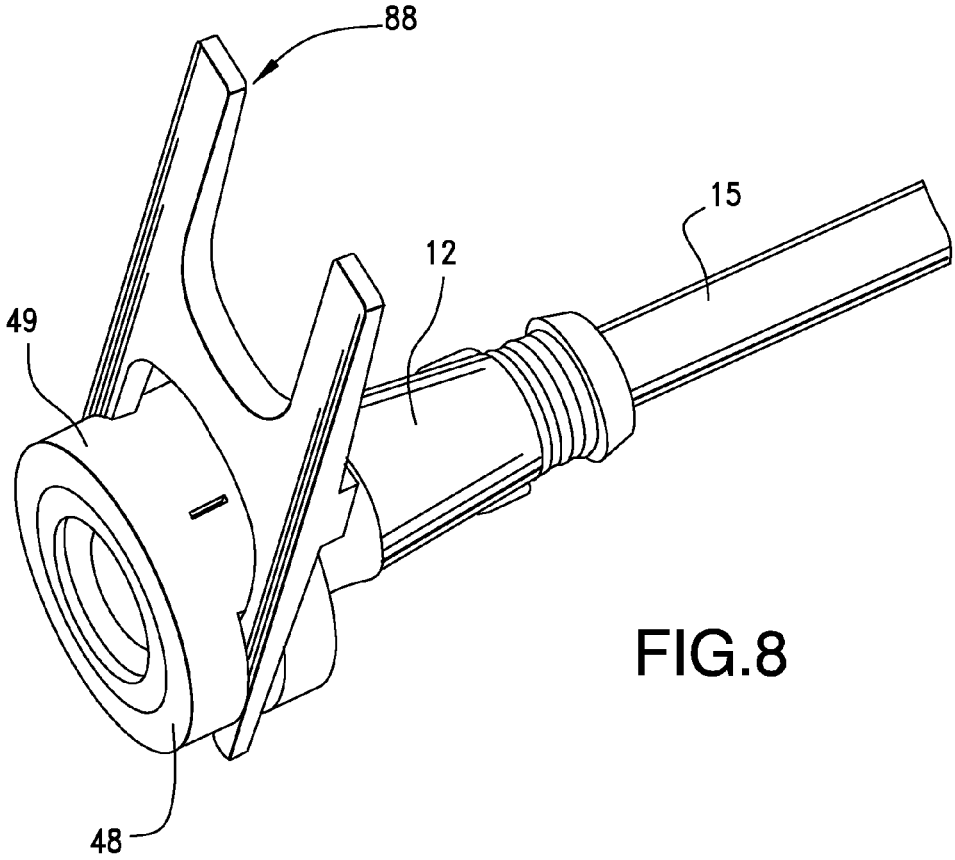
FIG. 8 is a color rendering taken from a perspective above, frontal and to the side of a female connector and locking clip with the uncoupling tool in the uncoupling position.
Figure 9:
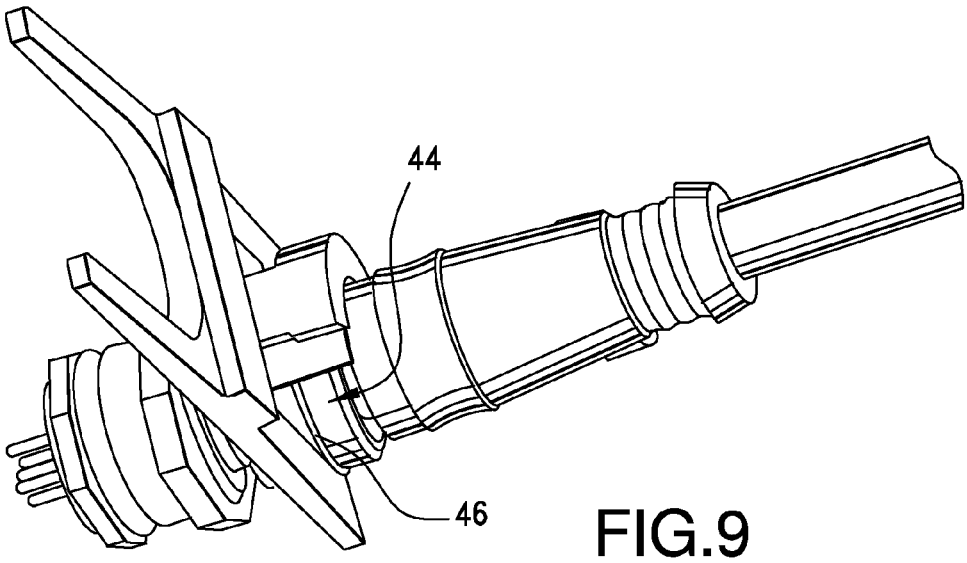
FIG. 9 is a color rendering of a male and female connector in connected relation, taken from an upper, rear and side perspective with the near clip half removed to view the actuating sleeve.
Figure 10:
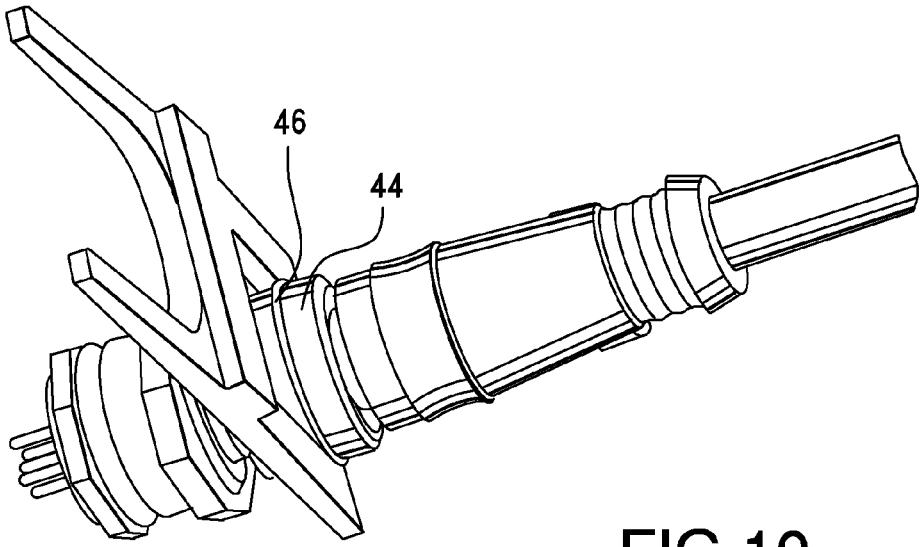
FIG. 10 is a color rendering similar to FIG. 9 with both clip halves removed.

FIGS. 8, 9 and 10 illustrate the structure described above and the release function. FIG. 8 is an upper frontal perspective showing the uncoupling tool 88 in place for moving the actuator sleeve of the connector to the release position.

FIG. 9 is an upper perspective view with the near half safety clip removed, showing the rear surface of the near leg of the uncoupling tool 88 engaging the forward surface of the circumferential rim 46 of the actuator sleeve 44.

FIG. 10 is a view similar to FIG. 9, but with both halves of the safety clip removed to show the actuator sleeve and uncoupling tool.

Figure 11:
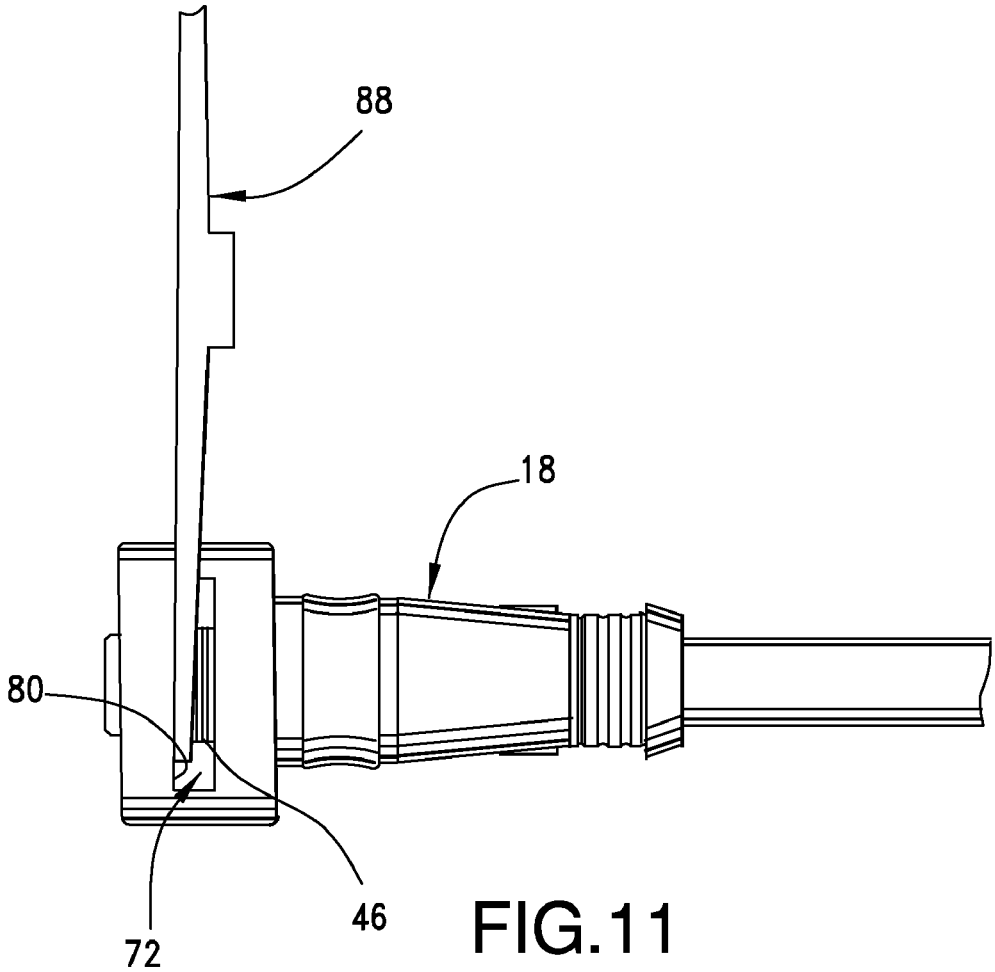
FIG. 11 is an opposing view of the female connector of FIG. 1 with the uncoupling tool applied to release the locking mechanism by being wedged between the front edge of the radial access opening of the clip half and the forward surface of the peripheral ring of the sliding actuator sleeve.

FIG. 11 is an opposing view of the female connector of FIG. 1 with the uncoupling tool 88 applied to release the locking mechanism by being wedged between the front edge 80 of the radical access opening 72 of the clip half 49 and the forward surface of the peripheral ring 46 of the sliding actuator sleeve 44.

Figure 12:
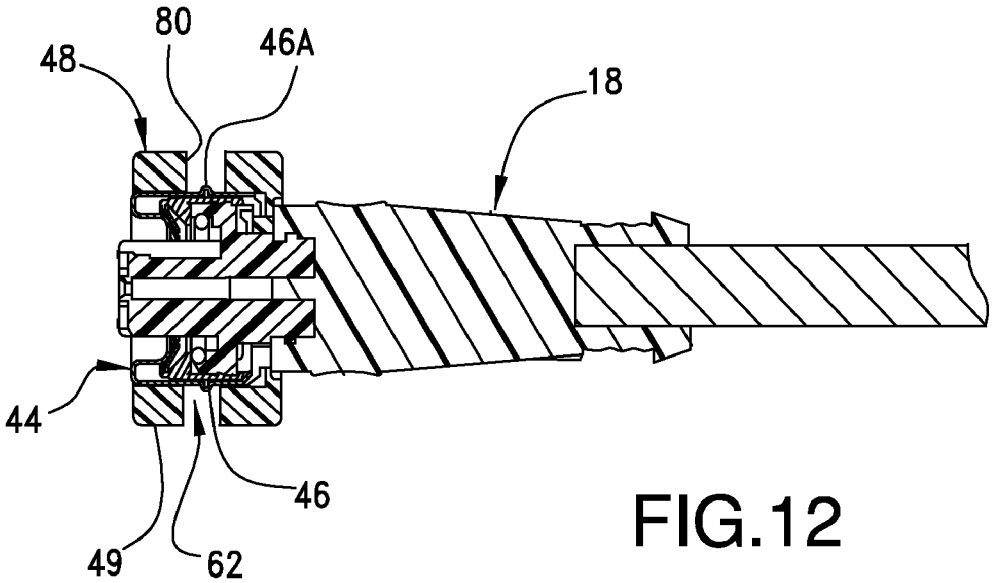
FIG. 12 is a longitudinal cross-sectional view of the connector assembly of FIG. 11 taken along a plane perpendicular to the plane of the page and passing through the center line C/L showing the space where the side legs of the decoupling tool are wedged between the fixed surface of the locking clip and the front surface of the peripheral ring on the actuator sleeve.

FIG. 12 is a longitudinal cross-section of the connector assembly of FIG. 11 taken along a plane perpendicular to the plane of the page and passing through the center line C/L showing the space 62 where the side legs of the decoupling tool are wedged between the fixed surface 80 of the locking clip and the front surface 46A of the peripheral ring 46 on the actuator sleeve 46.

Having thus disclosed in detail an embodiment of the invention, persons skilled in the art will be able to modify the structure illustrated and substitute equivalent elements for those disclosed; and it is, therefore, intended that all such substitutions and equivalents be covered as they are embraced within the scope of the appended claims.

The invention claimed is:

1. An electrical connector assembly comprising:

first and second generally cylindrical electrical connectors adapted for mutual engagement for establishing electrical contact between the two electrical connectors, wherein said first electrical connector includes a deformable, resilient, annular locking spring disposed on an outer surface thereof and defines a receiving opening, and wherein said second electrical connector includes an outer cylindrical coupling member thereon;

an axially slidable actuator sleeve disposed about and in contact with said first connector and adapted for sliding engagement with said second connector when said connectors are engaged, wherein said actuator sleeve engages said locking spring to increase the size of said receiving opening thereby releasing said second connector from said first connector when said actuator sleeve slides in a direction away from said second electrical connector;

a locking clip having two generally cylindrical mating sections and adapted for assembly and non-removable positioning about adjacent portions of said first and second electrical connectors to prevent inadvertent disconnection of said first and second electrical connectors, wherein each of said mating sections has a respective access opening therein, with said access openings disposed in opposing portions of said locking clip, and wherein said locking clip covers and prevents manual manipulation of said actuator sleeve; and an uncoupling tool having first and second spaced-apart legs each adapted for insertion into a respective access opening of a mating section of said locking clip for engaging and displacing said actuator sleeve along an axis defined by said first and second electrical connectors so as to deflect an inner portion of said locking spring outward and release the second electrical connector's coupling member from said locking spring, thereby permitting separation of said first and second electrical connectors.

2. The electrical connector assembly of claim 1, wherein the outer cylindrical coupling member of said second electrical connector includes a circumferential groove therein adapted for receiving said locking spring in a tight-fitting manner.

3. The electrical connector assembly of claim 1, wherein said locking spring is in the form of a circular, generally flat washer having plural resilient, inwardly extending tines adapted for positioning in said circumferential groove when said first and second electrical connectors are in mutual engagement.

4. The electrical connector assembly of claim 3, wherein an inner portion of said actuator sleeve engages and outwardly deflects said tines when said uncoupling tool displaces said actuator sleeve along the electrical connector axis.

5. The electrical connector assembly of claim 4, wherein said tines on said flat washer further extend in a direction along said axis away from said second electrical connector.

6. The electrical connector assembly of claim 1, wherein said actuator sleeve engages said locking spring and is urged in a first direction toward said second electrical connector by said locking spring when said first and second connectors are in mutual engagement.

7. The electrical connector assembly of claim 6, wherein said uncoupling tool overcomes the urging of said locking spring on said actuator sleeve so as to displace said actuator sleeve in a second, opposed direction when said uncoupling tool is inserted into said locking clip for separating the first and second electrical connectors.

8. The electrical connector assembly of claim 7, wherein the first and second legs of said uncoupling tool are tapered toward a distal end of a leg so that, as said legs are further inserted into a respective aperture of the locking clip, said actuator sleeve is further displaced along said axis and an inner portion of said locking spring is further deflected outwardly for separating said first and second electrical connectors.

9. The electrical connector assembly of claim 8, wherein each of the locking clip's cylindrical mating sections further includes an inner circumferential groove continuous with an associated access opening in the mating section, and wherein said actuator sleeve includes an outer circumferential rib disposed within the inner circumferential groove of said locking clip when said first and second connectors are in mutual engagement.

10. The electrical connector assembly of claim 9, wherein the access openings of the locking clip's cylindrical mating sections are in the form of elongated outer slots disposed about a portion of the outer periphery of each of said mating sections and extending into the locking clip's inner circumferential groove.

11. The electrical connector assembly of claim 10, wherein the tapered legs of said uncoupling tool are disposed between and engage the actuator sleeve's outer circumferential rib and an inner portion of the locking clip defining its inner circumferential groove so as to displace said actuator sleeve along said axis in a direction away from said second electrical connector thereby increasing the size of a receiving opening of said locking spring for separating said first and second electrical connectors.

12. The electrical connector assembly of claim 1, wherein opposed ends of the locking clip's cylindrical mating sections include respective complementary tongues and receptacles for securely connecting said first and second mating sections.

13. The electrical connector assembly of claim 12, where each of said tongues includes a respective barbed tongue extension and each of said receptacles includes a respective inner groove adapted to receive a barbed tongue extension allowing said locking clip to be assembled manually in a snap-acting manner.

14. The electrical connector assembly of claim 13, wherein said first electrical connector includes a generally circular end opening for receiving said second electrical connector in a tight-fitting manner.

15. The electrical connector assembly of claim 1, wherein the apertures in the locking clip's mating sections are in the form of elongated slots aligned generally transverse to the axis defined by said first and second electrical connectors.

16. The electrical connector assembly of claim 1, wherein said locking clip is comprised of high strength plastic.

17. The electrical connector assembly of claim 1, wherein said first electrical connector includes an overmold and a receiving sleeve disposed in spaced relation along said axis, and wherein said locking clip includes a retainer flange on one end thereof, and wherein the retainer flange of said locking clip is disposed intermediate said overmold and said receiving sleeve for maintaining said locking clip in position on said first electrical connector.

18. The electrical connector assembly of claim 1, wherein said uncoupling tool is generally U-shaped.

19. The electrical connector assembly of claim 1, wherein the two mating sections of said locking clip are identical in size and configuration.

* * * * *